US006839056B2

(12) United States Patent
Nagai et al.

(10) Patent No.: US 6,839,056 B2
(45) Date of Patent: Jan. 4, 2005

(54) DRIVE CIRCUIT OF DISPLAY AND DISPLAY

(75) Inventors: Yoshifumi Nagai, Anan (JP); Ryuhei Tsuji, Anan (JP)

(73) Assignee: Nichia Corporation, Tokushima (JP)

( * ) Notice: Subject to any disclaimer, the term of this patent is extended or adjusted under 35 U.S.C. 154(b) by 253 days.

(21) Appl. No.: 10/089,043

(22) PCT Filed: Jul. 27, 2001

(86) PCT No.: PCT/JP01/06514

§ 371 (c)(1),
(2), (4) Date: Jun. 17, 2002

(87) PCT Pub. No.: WO02/11115

PCT Pub. Date: Feb. 7, 2002

(65) Prior Publication Data

US 2002/0163514 A1 Nov. 7, 2002

(51) Int. Cl.[7] ..... G09G 3/30
(52) U.S. Cl. ..... 345/204; 345/36; 345/96
(58) Field of Search ..... 345/36, 38, 39, 345/42, 45, 76, 77, 80, 96, 204, 690

(56) References Cited

U.S. PATENT DOCUMENTS

| | | | | |
|---|---|---|---|---|
| 4,608,522 A | * | 8/1986 | Yuasa et al. | 315/241 P |
| 4,675,518 A | * | 6/1987 | Oimura et al. | 250/205 |
| 4,996,471 A | * | 2/1991 | Gallo | 323/241 |
| 6,529,178 B1 | * | 3/2003 | Kimura | 345/76 |

FOREIGN PATENT DOCUMENTS

| | | |
|---|---|---|
| JP | 59-126967 | 7/1984 |
| JP | 64-059880 | 3/1989 |
| JP | 1-59880 | 4/1989 |
| JP | 5-308720 | 11/1993 |
| JP | 7-266619 | 10/1995 |
| JP | 11-87774 | 3/1999 |
| JP | 11-087774 | 3/1999 |
| JP | 2000-183282 | 6/2000 |
| JP | 2000-339572 | 12/2000 |
| JP | 2001-42786 | 2/2001 |
| JP | 2001-042786 | 2/2001 |

* cited by examiner

*Primary Examiner*—Amare Mengistu
*Assistant Examiner*—Vincent E. Kovalick
(74) *Attorney, Agent, or Firm*—Wenderoth, Lind & Ponack, L.L.P.

(57) ABSTRACT

A driving circuit in a display apparatus includes a current driving unit for supplying a driving current in a forward direction to a light emitting element based on control data. The current driving unit is furnished with a function of supplying a predetermined current in a reverse direction to the light emitting element. The driving circuit further includes a voltage comparing unit for judging whether a reverse voltage necessary to supply the predetermined current in the reverse direction is smaller than a predetermined voltage. The driving circuit notifies an abnormal condition of the light emitting element based on a judgment by the voltage comparing unit. Consequently, it is possible to detect a light emitting element generating a leak current in a reverse direction of the light emitting element even when the light emitting element is connected to the driving circuit.

12 Claims, 4 Drawing Sheets

DRIVE CIRCUIT OF DISPLAY AND DISPLAY

TECHNICAL FIELD

The present invention relates to a driving circuit of a display apparatus and a display apparatus furnished with a function of detecting or notifying an abnormal condition of a light emitting element, and more specifically to a driving circuit of a display apparatus comprising a plurality of light emitting elements aligned in a matrix and to the display apparatus.

BACKGROUND ART

Recently, high-luminance light emitting elements, such as light emitting diodes (hereinafter, occasionally abbreviated to LEDs), have been developed for each of RGB that stands for red, green, and blue known as primary colors of light, and the production of large-scale self-luminance full color displays is being started. Among others, LED displays have characteristics that they can be lightweight and slimmed-down, and that they consume less power, etc. Hence, a demand for the LED displays as large-scale displays that can be used outdoors has been sharply increasing. Also, the use of the LED displays has been diversified, and there has been a need for a system flexibly adaptable to various applications, such as large-scale TV sets, advertisements, billboards, traffic information, stereoscopic displays, and illuminations.

Generally, the dynamic driving method is used as a driving method of the LED display. To be more specific, in the case of an LED display composed of a dot matrix with m row and n columns (m and n are integers equal to 2 or greater), the anode terminals of the LEDs positioned on each row are commonly connected to one common line, and the cathode terminals of the LEDs positioned on each column are commonly connected to one current supply line. As many common lines as m rows are switched ON successively at a predetermined cycle, and an LED driving current is supplied to as many current supply lines as n columns according to image data corresponding to the switched-ON line. Consequently, the LED driving current according to the corresponding image data is applied to the LED in each pixel, whereby an image is displayed.

In the case of a large-scale LED display set outdoors, a plurality of LED units are combined to form the LED display in general, and respective portions of the entire image data are displayed on the respective LED units. The LED units are provided with sets of RGB light emitting diodes aligned in a dot matrix on the substrate, and each unit operates in the same manner as the LED display described above. In the case of a large-scale LED display of a large size, one LED display is composed of, for example, a total of 120,000 LEDs in a 300 by 400 array.

On the other hand, it is customary to inspect a leakage current when the LED units are shipped. FIG. 4 shows how the leakage current is inspected with respect to LEDs 11 packaged in an LED panel 1A. According to a related art, in a case where the LED panel 1A having the packaging of a plurality of LEDs 11 is separated from a driving circuit substrate having thereon mounted driving circuits for driving the plurality of LEDs 11, as shown in FIG. 4, the inspection is conducted by using the LED panel 1A. As to the inspection of a reverse leakage current in an LED device, a constant voltage is applied in a reverse direction of the LEDs 11 (at the cathode side) and an ammeter is inserted at the anode side, under which conditions whether a leakage current is generated or not is measured by successively switching the respective lines. The shipping inspection is conducted by, for example, replacing an LED 11 generating a leakage current.

According to the above inspection method, however, there is a problem that the LED panel and the driving circuit substrate are separated and present independently, and the inspection is possible only at the time of production. According to this method, once the LED panel and the driving circuit substrate are electrically connected and combined with each other, the inspection is no longer possible. In other words, after the components are mounted, the horizontal driving units are connected to the LEDs at the cathode side, which makes it impossible to apply a reverse voltage. Also, in the case of a structure that the LED panel and the driving circuit substrate are formed in one body, a reverse voltage cannot be applied at the production inspection, and there is a problem that it is impossible to inspect an LED having a reverse leakage current being present therein.

The present invention is devised to solve the above problems, and therefore, is aimed at providing a driving circuit of a display apparatus and a display apparatus capable of detecting a light emitting element generating a leakage current in a reverse direction of the light emitting element even when the light emitting element is connected to the driving circuit.

DISCLOSURE OF THE INVENTION

A driving circuit in a display apparatus of the invention includes a current driving unit for supplying a driving current in a forward direction to a light emitting element based on control data. In particular, the current driving unit is furnished with a function of supplying a predetermined current in a reverse direction to the light emitting element. Further, the driving circuit is characterized in that it includes a voltage comparing unit for comparing a reverse bias voltage generated when the predetermined current in the reverse direction is supplied to the light emitting element with a predetermined voltage, so that it detects an abnormal condition of the light emitting element based on a comparison by the voltage comparing unit.

Also, in the driving circuit of a display apparatus of the invention, the current driving unit is characterized in that it is provided with a first current driving unit for supplying the driving current in the forward direction to the light emitting element and a second current driving unit for supplying the current in the reverse direction to the light emitting element.

Further, a display apparatus of the invention includes a plurality of light emitting elements, a common line to which the light emitting elements are connected, and a driving circuit provided with a current driving unit for supplying a driving current in a forward direction to the light emitting elements through a plurality of current supply lines based on control data. In particular, the current driving unit is furnished with a function of supplying a predetermined current in a reverse direction to the light emitting elements. Further, the driving circuit is characterized in that it is provided with a voltage comparing unit for comparing a reverse bias voltage generated when the predetermined current in the reverse direction is supplied to the light emitting elements with a predetermined voltage, so that it detects which of the light emitting elements connected to the current supply lines has an abnormal condition based on a comparison by the voltage comparing unit.

Furthermore, the display apparatus of the invention includes a plurality of lines as the common line. The display apparatus includes a vertical driving unit for switching the plurality of common lines, and a driving control unit for controlling the vertical driving unit and the current driving unit based on the control data. In other words, the driving control unit can detect which light emitting element has an abnormal condition based on a common line selected by the vertical driving unit, on which the driving current in the forward direction is not supplied to a light emitting element, and a judgment by the voltage comparing unit.

Also, the display apparatus of the invention includes a plurality of lines as the common line, and can be further provided with a vertical driving unit for switching the plurality of common lines, a driving control unit for controlling the vertical driving unit and the current driving unit based on the control data, and a grounded switch unit for selectively grounding the plurality of common lines. In other words, not only can the driving control unit control a selection of grounding of the common lines by the grounded switch unit, but also it can detect which light emitting element has an abnormal condition based on a common line selected by the grounded switch unit and thereby being in a grounded state and a judgment by the voltage comparing unit.

Also, the driving control unit is characterized in that it controls in such a manner that the selection of grounding of the common lines by the grounded switch unit is effected to a common line selected by the vertical driving unit, on which the driving current in the forward direction is not supplied to a light emitting element.

Also, in the display apparatus of the invention, a common line connected to a light emitting element that is to be supplied with the predetermined current in the reverse direction is a common line on which the driving current in the forward direction is not supplied to the light emitting element. Further, a current supply line connected to the light emitting element that is to be supplied with the predetermined current in the reverse direction is a current supply line through which the driving current in the forward direction is not supplied to the light emitting element. Furthermore, the common line connected to the light emitting element that is to be supplied with the predetermined current in the reverse direction is kept in the grounded state by the grounded switch unit.

In addition, the display apparatus of the invention is characterized in that it performs control of the light emitting elements through the vertical driving unit and the current driving unit based on the control data, and detection of an abnormal condition of a light emitting element based on the common line selected by the grounded switch unit and thereby being in the grounded state and the judgment by the voltage comparing unit by means of time division.

Also, the display apparatus of the invention is characterized in that the current driving unit is provided with a first current driving unit for supplying the driving current in the forward direction to the light emitting elements and a second current driving unit for supplying the current in the reverse direction to the light emitting elements.

Further, the display apparatus of the invention is characterized in that the control data is image display data for displaying an image, so that the display apparatus performs an image display based on the image display data.

Furthermore, the display apparatus of the invention is characterized in that the control data is illumination data used for illumination, so that the display apparatus performs illumination lighting based on the illumination data.

Moreover, the display apparatus of the invention is characterized in that the plurality of light emitting elements are aligned in a matrix.

BEST MODE FOR CARRYING OUT THE INVENTION

Figure 1:
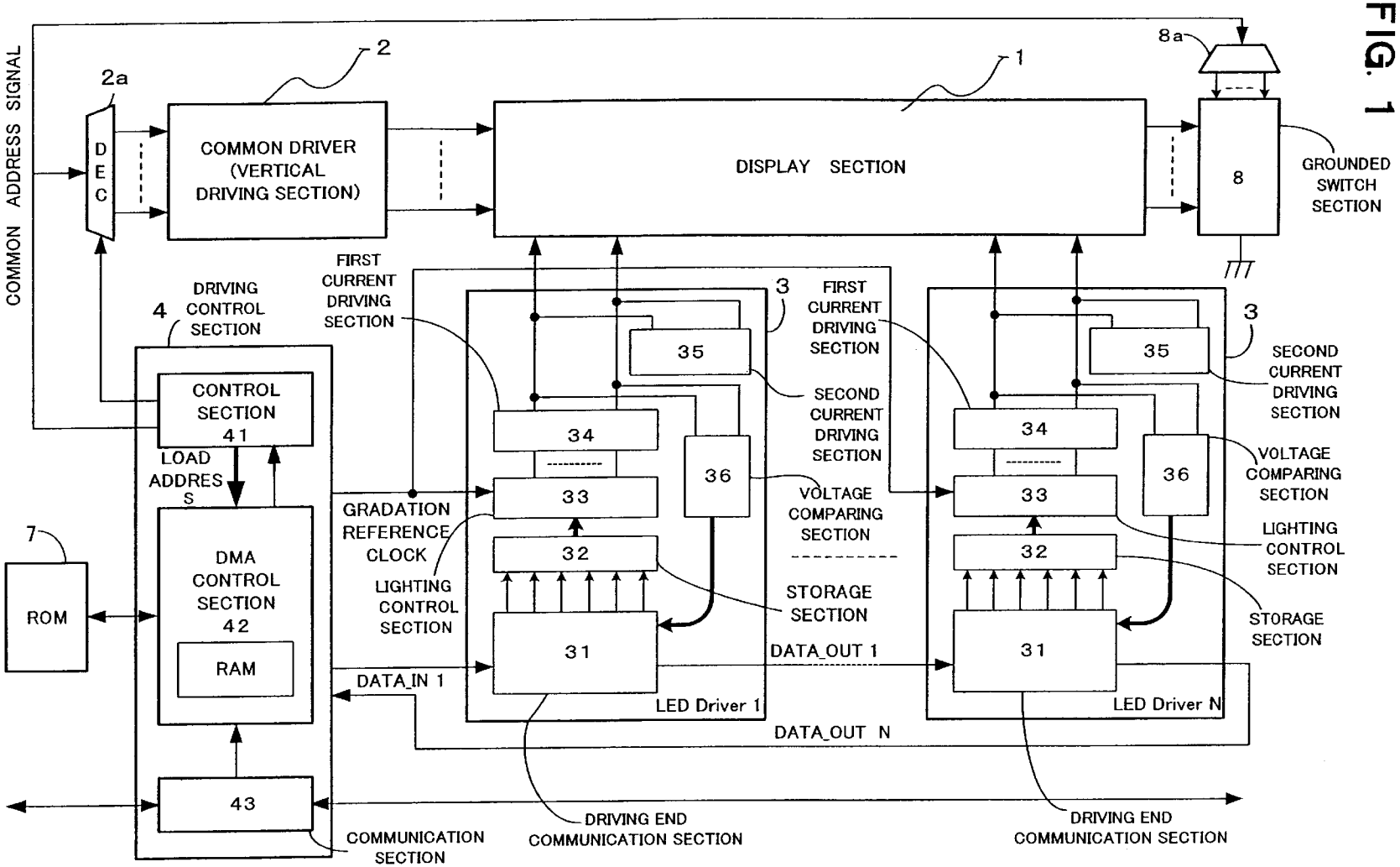
FIG. 1 is a block diagram schematically showing an example of a display apparatus according to one embodiment of the invention.

The following description will describe an embodiment of the invention. It should be appreciated that a display apparatus of the invention is not limited to an image display apparatus for displaying a video, such as a still image and a motion image. In the present specification, the display apparatus includes a display board for displaying text information, such as characters and numerics, and an illuminating system. In particular, by using a high-luminance LED as a light emitting element, it is possible to use the present invention for illumination with illumination colors and luminance being controllable. Hence, regardless of the title of the invention, it is an intention of the invention to encompass an illuminating system that does not display an image within the scope thereof.

In the specification, control data means various kinds of data necessary in displaying an image or in lighting when used for illumination, including image data, luminance correction data, constant current adjustment data, enable control, horizontal synchronization data, etc. In the specification, the control data is occasionally referred to simply as data for ease of explanation. Also, data displayed by a display driving apparatus is not limited to full color image data, and the apparatus can be used for displaying a subtracted video, a display with the number of colors being limited to, for example, two or three, a monochrome gray-scale representation, etc. Further, the apparatus can be used for displaying not only an image, but also characters and graphic data. Alternatively, the apparatus can be used for illumination, and when used as illumination, the apparatus can change levels of illumination intensity or add dimmer control. In the specification, the display driving apparatus is a term used to mean an apparatus including an illumination system used for illumination and as any other light source.

A driving circuit of a display apparatus of the invention is a driving circuit of a display apparatus including a current driving unit for supplying a driving current in a forward direction to a light emitting element based on control data. In particular, the current driving unit is furnished with a function of supplying a predetermined current in a reverse direction to the light emitting element, and further, the driving circuit includes a voltage comparing unit for comparing a reverse bias voltage of the light emitting element with a predetermined voltage when the predetermined current in the reverse direction is supplied, so that it can detect an abnormal condition of the light emitting element based on a judgment by the voltage comparing unit. In short, the driving circuit of a display apparatus of the invention is furnished with a function of notifying an abnormal condition of a light emitting element by detecting a leakage current in the light emitting element.

Also, a display apparatus of the invention is a display apparatus composed of a plurality of light emitting elements, a common line to which the light emitting elements are connected, and a driving circuit provided with a current driving unit for supplying a driving current in a forward direction to the light emitting elements through a plurality of current supply lines based on control data. In particular, the current driving unit is furnished with a function of supplying a predetermined current in a reverse direction to the light emitting elements, and further, the driving circuit is provided with a voltage comparing unit for comparing a reverse bias voltage of the light emitting elements with a predetermined voltage when the predetermined current in the reverse direction is supplied, so that it can detect which of the light emitting elements connected to the current supply lines has an abnormal condition based on a judgment by the voltage comparing unit. In short, the display apparatus of the invention is furnished with a function of notifying an abnormal condition of a light emitting element by detecting a leakage current in the light emitting element.

For example, in case that the display apparatus of the invention is a display apparatus including a plurality of lines as the common line, and the display apparatus further includes a vertical driving unit for switching the plurality of common lines, and a driving control unit for controlling the vertical driving unit and the current driving unit based on image display data, the driving control unit can detect which light emitting element has an abnormal condition based on a common line selected by the vertical driving unit, on which the driving current in the forward direction is not supplied to a light emitting element, and a judgment by the voltage comparing unit. Consequently, even when the display apparatus includes a plurality of common lines, it is possible to detect which light emitting element has an abnormal condition.

Also, in case that the display apparatus including a plurality of lines as the common line further includes a vertical driving unit for switching the plurality of common lines, a driving control unit for controlling the vertical driving unit and the current driving unit based on image display data, and a grounded switch unit for selectively grounding the plurality of common lines, not only can the driving control unit control a selection of grounding of the common lines by the grounded switch unit, but also it can detect which light emitting element has an abnormal condition based on a common line selected by the grounded switch unit and thereby being in a grounded state and a judgment by the voltage comparing unit. Consequently, even when the display apparatus includes a plurality of common lines, it is possible to detect which light emitting element has an abnormal condition.

As has been discussed, in case that the vertical driving unit and the grounded switch unit are provided separately, the driving control unit controls in such a manner that the selection of grounding of the common lines by the grounded switch unit is effected to a common line selected by the vertical driving unit, on which the driving current in the forward direction is not supplied to a light emitting element. Consequently, it is possible to detect an abnormal condition of a light emitting element efficiently.

Also, it may be arranged in such a manner that a common line connected to a light emitting element that is to be supplied with the predetermined current in the reverse direction is a common line on which the driving current in the forward direction is not supplied to the light emitting element, further, a current supply line connected to the light emitting element that is to be supplied with the predetermined current in the reverse direction is a current supply line through which the driving current in the forward direction is not supplied to the light emitting element, and the common line connected to the light emitting element that is to be supplied with the predetermined current in the reverse direction is kept in the grounded state by the grounded switch unit. Consequently, it is possible to detect an abnormal condition of a light emitting element efficiently.

Also, the display apparatus of the invention can perform control of the light emitting elements through the vertical driving unit and the current driving unit based on the control data, and detection of an abnormal condition of a light emitting element based on the common line selected by the grounded switch unit and thereby being in the grounded state and the judgment by the voltage comparing unit by means of time division. Consequently, it is possible to detect an abnormal condition of a light emitting element while the display apparatus of the invention is displaying a predetermined image. To be more specific, in case that a display by the light emitting elements is controlled by a pulse current, for example, it seems to human eyes as if each light emitting element were kept lighted continuously. In reality, however, each light emitting element is repetitively lighted up and out in a short time. Hence, by supplying the current in the reverse direction to a light emitting element while the light emitting element is not lighted up, that is, while the driving current in the forward direction is not supplied to the light emitting element, it is possible to detect an abnormal condition of the light emitting element.

Also, the current driving unit in the driving circuit of a display apparatus and the display apparatus of the invention may be arranged so that it is provided with a first current driving unit for supplying the driving current in the forward direction to the light emitting elements and a second current driving unit for supplying the current in the reverse direction to the light emitting elements. Further, the display apparatus of the invention is applicable to a display apparatus including at least one common line and driving the light emitting elements through a plurality of current supply lines.

Embodiment

The following description will describe an embodiment of the invention with reference to the drawings. It should be appreciated, however, that the embodiment described below is an illustration of a driving circuit of a display apparatus and a display apparatus to give a concrete form to technical ideas of the invention, and a driving circuit of a display apparatus and a display apparatus of the invention are not especially limited to the description below.

FIG. 1 is a block diagram schematically showing a display apparatus according to one embodiment of the invention. A display apparatus shown in FIG. 1 includes: (a) a display unit 1 provided with a plurality of LEDs, which are light emitting elements, aligned in a matrix with m row and n column (m and n are integers equal to 2 or greater); (b) a vertical driving unit 2 (common driver) for selecting the respective rows in the display unit 1 based on a common address signal and applying a current to the respective row; (c) a grounded switch unit 8 for performing ON/OFF control with respect to the GND ground of each common line based on the common address signal; (d) horizontal driving units 3 (LED Driver 1 through LED Driver N), which are driving circuits for supplying a driving current to the respective columns in the display unit 1 through a plurality of current supply lines based on image display data corresponding to the selected row; (e) a DMA control unit 42 for correcting image display data (IMDATA) inputted from an external apparatus in response to light emitting characteristics that vary from pixel to pixel to be outputted to the horizontal driving units 3; (f) a correction data storage unit 7 for storing correction data for the aforementioned correction, the operation of each component being controlled by a control unit 41; (g) a communication unit 43 for sending/receiving various kinds of data to/from an external controller to send a command to the DMA control unit 42 or the control unit 41 within the display apparatus; and (h) a driving end communication unit 31 for handling data reception processing between the DMA control unit 42 and the horizontal driving units 3 in the interior of the display apparatus. The external controller provides only the data controlling the display apparatus, and a signal necessary in driving the interior of the display apparatus is self-generated in the interior of the display apparatus, so that a lighting display is performed by supplying a driving current to the respective light emitting elements.

The display unit 1 is provided with a plurality of light emitting elements aligned in a matrix with m rows and n columns on the substrate on where a conduction pattern is preformed. LEDs, ELs, PDPs, etc. are used as the light emitting elements. In the present embodiment, one pixel is composed of a set of adjacent three light emitting diodes respectively capable of emitting red, green, and blue (RGB) light. The light emitting elements forming one pixel may be arranged in such a manner that LEDs for two colors are provided in close proximity, two or more LEDs are provided per color, or the number of LEDs is changed for colors. The LEDs for RGB aligned adjacently in each pixel can realize a full-color display. The present embodiment shows the display unit 1 provided with a plurality of light emitting elements aligned in a matrix with m rows and n columns as an example, but the number of the light emitting elements connected to the common lines corresponding to the respective rows may not be constant.

A semiconductor light emitting element capable of emitting various kinds of light can be used as the light emitting diode. Examples of the semiconductor element include those using, as a light emitting layer, a semiconductor, such as GaP, GaAs, GaN, InN, AlN, GaAsP, GaAlAs, InGaN, AlGaN, AlGaInP, and InGaAlN. Also, the structure of the semiconductor may be the homo structure, the hetero structure, or the double hetero structure having the MIS junction, PIN junction, or the PN junction.

By selecting materials of the semiconductor layer and a degree of mixed crystals thereof, it is possible to select a wavelength of light emitted from the semiconductor light emitting element that ranges from an ultraviolet ray to an infrared ray. Further, in order to offer a quantum effect, a single-quantum-well structure or a multi-quantum-well structure using the light emitting layer of a thin film is also available.

Besides the light emitting diodes for RGB primary colors, it is also possible to use a light emitting diode that combines light from an LED and a fluorescent material that emits light upon excitation by light from the LED. In this case, by using a fluorescent material that is excited by light from the light emitting diode and emits light transformed into long wavelength light, it is possible to obtain a light emitting diode capable of emitting light of a color tone, such as white, with satisfactory linearity by using one kind of light emitting element.

Further, a light emitting diode of various shapes can be used. Examples of the form include a shell type made by electrically connecting an LED chip serving as the light emitting element to a lead terminal and by coating the same with molding compounds, a chip type LED, a light emitting element per se, etc.

The common driver serving as the vertical driving unit 2 and the grounded switch unit 8 are controlled by way of their respective decoder units 2*a* and 8*a* based on the common address signal supplied from the control unit 41. The data inputted from the DMA control unit 42 to each horizontal driving unit 3 is received by the driving end communication unit 31 and stored in the storage unit 32. A lighting control unit 33 controls a first current driving unit 34 based the data stored in the storage unit 32 and a gradation reference clock.

The horizontal driving unit 3 is composed of the driving end communication unit 31, storage unit 32, lighting control unit 33, and first current driving unit 34. The driving end communication unit 31 handles communications of the control data necessary between the driving end communication unit 31 and the driving control unit 4 and between the driving end communication unit 31 and the driving end communication unit 31 provided in the horizontal control unit 3 in the following stage. Further, the driving end communication unit 31 writes data sent from the DMA control unit 42 in the driving control unit 4 into the storage unit 32 provided in the horizontal driving unit 3. The storage unit 32 is composed of a shift register or the like. The lighting control unit 33 receives the gradation reference clock and controls the first current driving unit 34 according to the image display data in the storage unit 32. The gradation reference clock is generally supplied from an external apparatus. It should be appreciated, however, that the gradation reference clock may be self-generated at the horizontal driving unit 3 end. The first current driving unit 34 performs constant current driving with respect to the LEDs 11. The horizontal driving units 3 are connected to the LEDs 11 aligned on the respective current supplying lines L2 in the column direction, and perform dynamic lighting by successively supplying a current to the LEDs in the vertical direction in sync with the switching by the vertical driving unit 2. The horizontal driving units 3 are composed of a semiconductor switching element, a driver IC, etc., and serve as LED driver units (LED Drivers 1 through N).

In the case of the example in FIG. 1, the DMA control unit 42 sends the image display data to the driving end communication unit 31, and the driving end communication unit 31 holds the reception image display data in the storage unit 32. The display unit 1 is successively switched per row by the vertical driving unit 2. A lighting control signal inputted into the lighting control unit 33 is enabled in sync with the start of an image display per common line L1 corresponding to each row in the display unit 1. A latch signal for holding the image display data is inputted in sync with this lighting control signal. The image display data is taken into the shift register provided in the storage unit 32, and a shift clock (SCLK) in sync with the taking-in operation is inputted into the driving end communication unit 31 within the validity period of the data.

The driving current per common line L1 supplied to the display unit 1 is supplied from the first current driving unit 34 provided in the horizontal driving unit 3. The common address signal is synchronized with the lighting control signal, and the control signal synchronized by the decoder 2*a* is inputted into the vertical driving unit 2, in response to which a driving current is supplied from the first current driving unit 34 in the horizontal driving unit 3 connected to the current supply line L2 for each column. The display unit 1 is lighted as it is switched successively per row by the vertical driving unit 2.

Also, the horizontal driving unit 3 includes a second current driving unit 35 for applying a current in a reverse direction to each LED 11, so that the fist current driving unit 34 applies the driving current in a forward direction during the normal lighting operation, and at the inspection of an abnormal condition of the LED 11, the lighting control unit 33 stops driving the first current driving unit 34, and starts driving the second current driving unit 35. Then, a voltage value at the output end of the horizontal driving unit 3 at that point is subjected to comparison by the voltage comparing unit 36. In case that the voltage value reaches or exceeds a predetermined reference voltage value, the reverse leakage current in the LED is deemed as being equal to or below a preset value, which makes it possible to inspect the presence or absence of an abnormal condition of the LED. Also, when the horizontal driving unit 3 detects an abnormal condition of the LED, it notifies the driving control unit 4 of which current supply line was being supplied with the current in the reverse direction when the abnormal condition of the LED was detected, whereby the driving control unit 4 detects which LED has an abnormal condition based on the current supply line from which the abnormal condition was detected and which common line was grounded at that point. The driving control unit 4 is composed of the control unit 41, DMA control unit 42, and communication unit 43. Also, the DMA control unit 42 includes an internal RAM and performs DMA (Direct Memory Access) control.

Also, during the normal operation, by inspecting the presence or absence of a reverse leakage current in checking deterioration of the LEDs with time, it is possible to detect an abnormal condition of each light emitting element, thereby achieving better maintenance.

Figure 2:
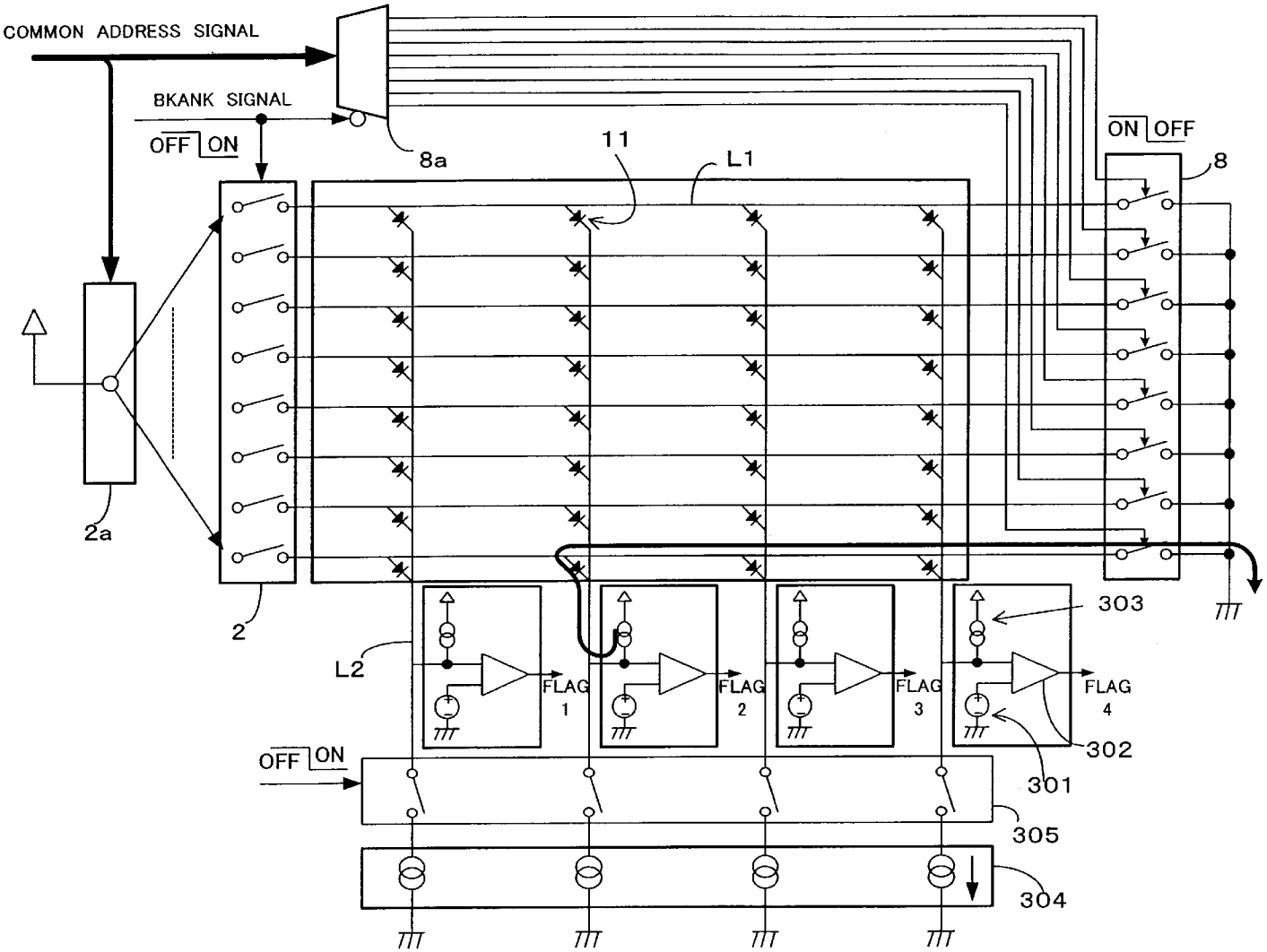
FIG. 2 is a view schematically showing a driving circuit to explain an operation when a light emitting element is inspected by using the embodiment of the invention.

FIG. 2 shows an example of a circuit diagram of the driving circuit for realizing the embodiment of the invention. The following description will describe, with reference to the drawing, an operation when a current in a reverse direction is applied to the LEDs 11 during the LED inspection. The grounded switch unit 8 switches the GND grounds of the common lines L1 in response to the condition specified by the common address signal. It is preferable that the grounded switch unit 8 switches ON the GND ground of the common line L1 when a supply of the driving current to the common line L1 is not selected by the vertical driving unit 2.

Conversely, the GND ground of the common line L1 is switched OFF when the common line L1 is selected for a supply of the driving current. In other words, the dynamic driving is performed, and when the driving current is supplied to the LED 11 connected to the common line L1 selected by the vertical driving unit 2 through a switch unit 305 and the current supply line L2 from a constant current source 304 corresponding to the first current driving unit 34, the GND ground in the grounded switch unit 8 connected to that common line L1 is switched OFF.

It should be appreciated, however, that it is also possible to detect a defective LED while the dynamic driving lighting is performed. For example, the lighting driving and the check of a leakage current are performed by means of time division. By applying a reverse bias to the LEDs that are not selected for the lighting driving from the vertical driving unit or driving control unit, it is possible to detect a defective LED while the display apparatus is driven without interfering with the light emitting operation of the other LEDs.

During the LED inspection, it is controlled in such a manner that the common lines L1 are selectively connected to the GND ground side by the grounded switch unit 8, and a constant current source 303 forming the second current driving unit 35 is driven, so that a reverse bias is applied in a reverse direction of the LED 11, that is, from the cathode side to the anode side. A voltage comparator 302 corresponding to the voltage comparing unit 36 is preset with a reference voltage value by a reference voltage setting circuit 301. The voltage comparator 302 operates based on this reference voltage value, and when a voltage value at the output end of the horizontal driving unit 3 is dropped to or below the reference voltage value due to a current supply from the constant current source 303, it performs a flag output and notifies the presence of an abnormal condition in the LED 11. The constant current source 303 and the voltage comparator 302 are provide to each output channel of the horizontal driving unit 3, that is, to each current supply line L2, and allow the LED inspection per dot with the switching operation of the common lines L1, which are subjected to inspection.

Also, by inputting an inverted signal of a blank signal inputted into the vertical driving unit 2 into the decoder 8*a* connected to the grounded switch unit 8, it is possible to release the charges accumulated in the LED 11 after the driving current is applied, thereby making it possible to prevent pseudo-lighting, a phenomenon that the LED 11 emits light slightly while no driving current is applied.

The embodiment described above shows an example case where the display apparatus has the grounded switch unit 8. However, it may be arranged so that the common lines L1 are selectively grounded by the vertical driving unit 2 during the LED inspection.

Figure 3:
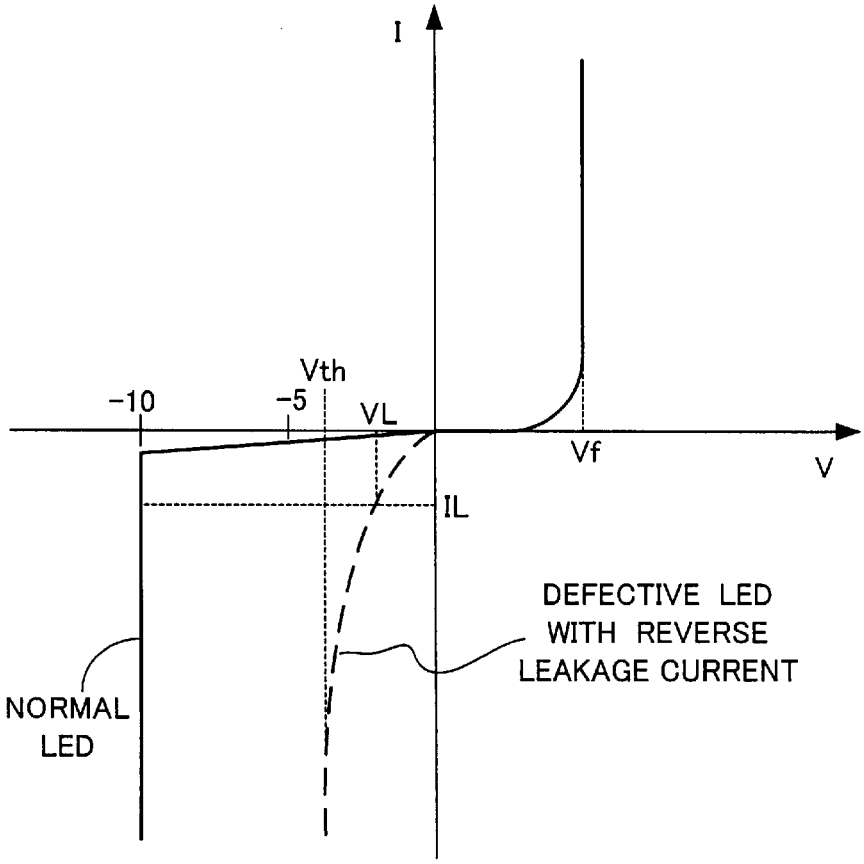
FIG. 3 is a graph showing an example of a V-I characteristics curve of an LED.
Figure 4:
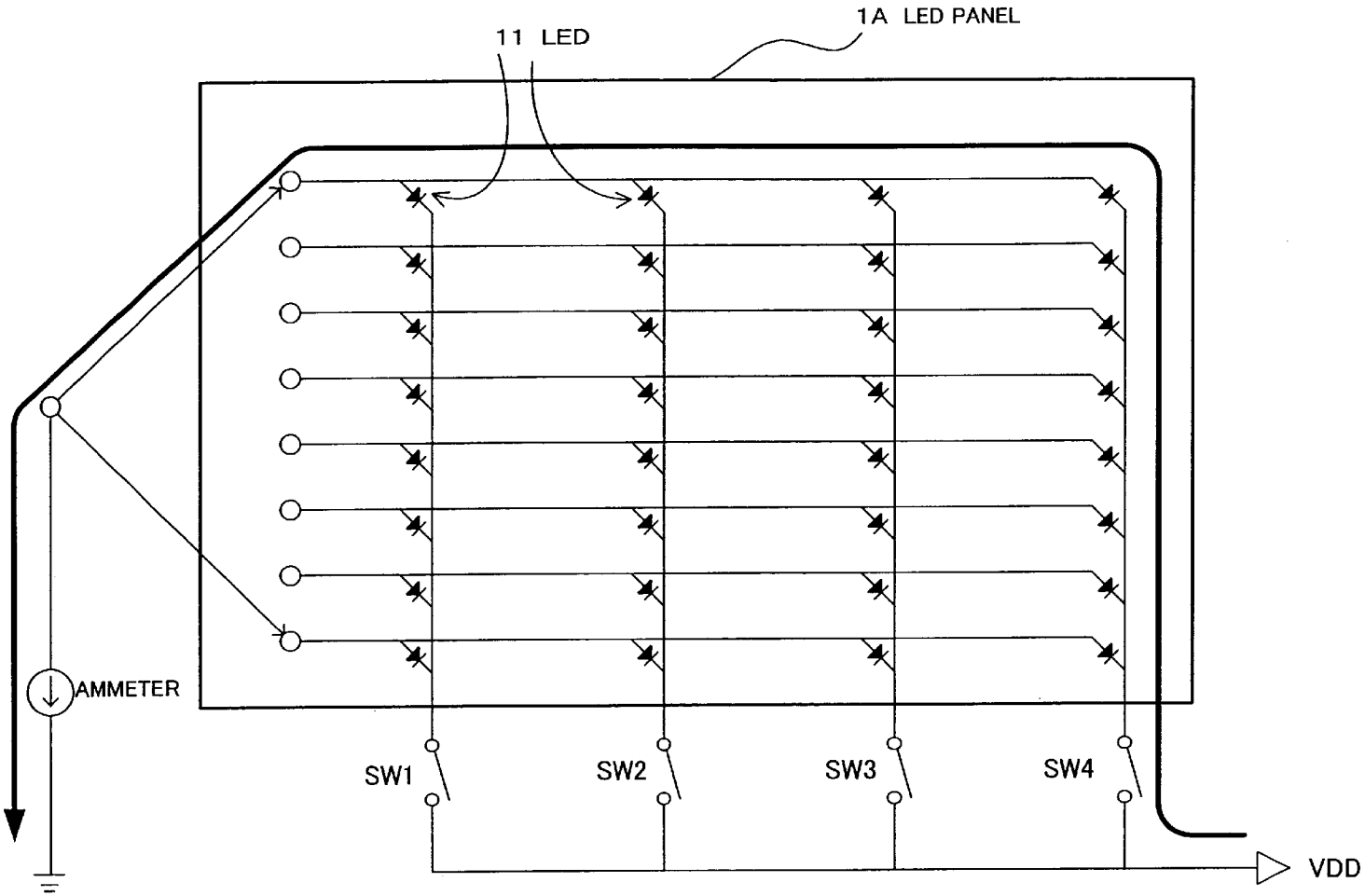
FIG. 4 is a view schematically showing an inspection method of an LED panel according to a related art.

FIG. 3 shows a V-I characteristics curve of the LED. A voltage in a plus direction represents a voltage applied in a forward direction of the LED and a current value represents a current flown at that time, whereas a voltage in a minus direction represents a voltage value applied in a reverse direction and a current represents a current value flown at that time. Vf represents a voltage value when a forward voltage is applied for the normal lighting driving of the LED. Vth represents a reference voltage value used for comparison by the voltage comparing unit 36. IL represents a current value flown by the second current driving unit 35 in a reverse direction of the LED, and VL (reverse bias voltage) represents a voltage value the output unit has at that time. According to the reverse leakage current detection of the invention, the voltage comparing unit judges a condition of the LED as normal when the VL value is a value that exceeds the Vth in a minus direction as indicated by a solid line in FIG. 3, and judges the generation of a leakage current, and hence, a condition of the LED as abnormal when the former is below the latter as indicated by a broken line.

The above description described the display apparatus provided with a plurality of LEDs aligned in a matrix. It is needless to say, however, that a display apparatus may be arranged so that pixels each formed from more than one LED are aligned in one line in one direction, or pixels each formed from one LED are aligned in one line in one direction.

As has been discussed, according to the invention, it is possible to provide a driving circuit of a display apparatus and a display apparatus capable of detecting a light emitting element generating a leakage current in a reverse direction of the light emitting element even when the light emitting element is connected to the driving circuit.

Also, according to the invention, it is possible to conduct the inspection of an abnormal condition of LEDs at the driving circuit end, so that the inspection can be conducted with an individual LED display apparatus without requiring a special inspection apparatus. Also, even when the LEDs and the driving circuit are provided on the same substrate, the inspection of an abnormal condition of the LEDs can be conducted. In addition, the inspection of an abnormal condition of the LEDs can be conducted when deterioration of the LEDs with time is checked while the display apparatus is generally operating at the installation spot. Hence, the invention can be used in estimating the LED deterioration or in making a maintenance schedule. Further, it is possible to optimize the voltage Vf applied to the output unit of the horizontal driving unit 3 in response to a change in VL (a voltage in a reverse direction necessary to supply a predetermined current in a reverse direction) by using the voltage comparing unit 36. In other words, by monitoring a voltage at the voltage comparing unit 36, an LED power voltage can be controlled, thereby making it possible to set the LED power voltage to an optimal voltage.

INDUSTRIAL APPLICABILITY

As has been discussed, by using the driving circuit of a display apparatus and the display apparatus of the invention, it is possible to flexibly adapt to various applications. For example, the invention can be applied to an LED display for use as large-scale TV sets, billboards, advertisements, traffic information, stereoscopic displays, illuminating systems, etc.

What is claimed is:

1. A driving circuit of a display apparatus including a current driving unit for supplying a driving current in a forward direction to a light emitting element based on control data, said driving circuit being characterized in that:

said current driving unit is furnished with a function of supplying a predetermined current in a reverse direction to said light emitting element;

said driving circuit further includes a voltage comparing unit for comparing a reverse bias voltage generated when said predetermined current in the reverse direction is supplied to said light emitting element with a predetermined voltage; and said driving circuit detects an abnormal condition of said light emitting element based on a comparison by said voltage comparing unit.

2. The driving circuit of a display apparatus according to claim 1, wherein:

said current driving unit is provided with a first current driving unit for supplying the driving current in the forward direction to said light emitting element and a second current driving unit for supplying the current in the reverse direction to said light emitting element.

3. A display apparatus, including:

a plurality of light emitting elements;

a common line to which said light emitting elements are connected; and a driving circuit provided with a current driving unit for supplying a driving current in a forward direction to said light emitting elements through a plurality of current supply lines based on control data, said display apparatus being characterized in that:

said current driving unit is further furnished with a function of supplying a predetermined current in a reverse direction to said light emitting elements;

said driving circuit is further provided with a voltage comparing unit for comparing a reverse bias voltage generated when said predetermined current in the reverse direction is supplied to said light emitting elements with a predetermined voltage; and said driving circuit detects which of said light emitting elements connected to said current supply lines has an abnormal condition based on a comparison by said voltage comparing unit.

4. The display apparatus according to claim 3, wherein:

said display apparatus includes a plurality of lines as said common line;

said display apparatus further includes, a vertical driving unit for switching said plurality of common lines, and a driving control unit for controlling said vertical driving unit and said current driving unit based on said control data; and said driving control unit detects which light emitting element has an abnormal condition based on a common line selected by said vertical driving unit, on which the driving current in the forward direction is not supplied to a light emitting element, and a judgment by said voltage comparing unit.

5. The display apparatus according to claim 3, wherein:

said display apparatus includes a plurality of lines as said common line;

said display apparatus further includes, a vertical driving unit for switching said plurality of common lines, a driving control unit for controlling said vertical driving unit and said current driving unit based on said control data, and a grounded switch unit for selectively grounding said plurality of common lines; and said driving control unit controls a selection of grounding of the common lines by said grounded switch unit, and detects which light emitting element has an abnormal condition based on a common line selected by said grounded switch unit and thereby being in a grounded state and a judgment by said voltage comparing unit.

6. The display apparatus according to claim 5, wherein:

said driving control unit controls in such a manner that the selection of grounding of the common lines by said grounded switch unit is effected to a common line selected by said vertical driving unit, on which the driving current in the forward direction is not supplied to a light emitting element.

7. The display apparatus according to claim 5, wherein:

a common line connected to a light emitting element that is to be supplied with said predetermined current in the reverse direction is a common line on which the driving current in the forward direction is not supplied to said light emitting element;

a current supply line connected to said light emitting element that is to be supplied with said predetermined current in the reverse direction is a current supply line on which the driving current in the forward direction is not supplied to said light emitting element; and the common line connected to said light emitting element that is to be supplied with said predetermined current in the reverse direction is kept in the grounded state by said grounded switch unit.

8. The display apparatus according to claim 5, wherein:

said display apparatus performs control of the light emitting elements through said vertical driving unit and said current driving unit based on said control data, and detection of an abnormal condition of a light emitting element based on the common line selected by said grounded switch unit and thereby being in the grounded state and the judgment by said voltage comparing unit by means of time division.

9. The display apparatus according to claim 3, wherein:

said current driving unit is provided with a first current driving unit for supplying the driving current in the forward direction to said light emitting elements and a second current driving unit for supplying the current in the reverse direction to said light emitting elements.

10. The display apparatus according to claim 3, wherein:

said control data is image display data for displaying an image, and said display apparatus performs an image display based on said image display data.

11. The display apparatus according to claim 3, wherein:

said control data is illumination data used for illumination, an said display apparatus performs illumination lighting based on said illumination data.

12. The display apparatus according to claim 3, wherein:

said plurality of light emitting elements are aligned in a matrix.

* * * * *